US005682757A

United States Patent [19]

Peterson

[11] Patent Number: 5,682,757

[45] Date of Patent: Nov. 4, 1997

[54] CONDENSATE LIQUID MANAGEMENT SYSTEM FOR AIR CONDITIONER

[75] Inventor: Gregory E. Peterson, Sylvan Lake, Mich.

[73] Assignee: Smart Power Systems, Inc., Sterling Heights, Mich.

[21] Appl. No.: 689,000

[22] Filed: Aug. 1, 1996

[51] Int. Cl.[6] ..... F25D 23/12; F25B 47/00; F28D 5/00

[52] U.S. Cl. ..... 62/259.2; 62/279; 62/305

[58] Field of Search ..... 62/272, 277, 280, 62/279, 290, 150, 259.2, 305, 238.6

[56] References Cited

U.S. PATENT DOCUMENTS

| | | | |
|---|---|---|---|
| 2,909,910 | 10/1959 | Saunders | 62/277 |
| 3,355,908 | 12/1967 | Anglin | 62/277 |
| 4,248,057 | 2/1981 | Yaguchi | 62/280 |
| 4,280,334 | 7/1981 | Lakdawala | 62/277 |
| 4,375,752 | 3/1983 | Stocking et al. | 62/150 |
| 5,113,668 | 5/1992 | Wachs et al. | 62/305 |
| 5,523,640 | 6/1996 | Sparer et al. | 62/259.2 |

*Primary Examiner*—William Doerrler
*Attorney, Agent, or Firm*—Brooks & Kushman P.C.

[57] ABSTRACT

An air conditioning system includes a compressor, a motor adapted for driving the compressor, a condenser in communication with the compressor, an expansion device, an evaporator which precipitates a condensate, and an electronic system controller. A liquid management system for the air conditioning system includes a reservoir for accumulating condensate precipitated from the evaporator and means for distributing the condensate for cooling at least one selected system component. A method of cooling an air conditioning system is also provided. The method includes capturing the condensate precipitated from the evaporator; distributing the condensate to various system components for cooling.

9 Claims, 5 Drawing Sheets

16
14
(GAS)
HIGH PRESSURE IMPELLER
12
LOW PRESSURE IMPELLER
18
40
CONDENSER
HOT AIR
38
EVAPORATOR
(GAS)
COOL AIR
20
26
(LIQUID)
DRIER
(LIQUID)
EXPANSION VALVE
(VALVE)
(VACUUM)
10
22
24

CONDENSATE LIQUID MANAGEMENT SYSTEM FOR AIR CONDITIONER

TECHNICAL FIELD

The present invention relates to air conditioning systems, and more particularly to a method and apparatus for cooling air conditioning system components.

BACKGROUND OF THE INVENTION

Typical refrigeration systems include a compressor, a motor adapted for driving the compressor, a condenser in fluid communication with the compressor, an expansion device in fluid communication with the condenser, an evaporator in fluid communication with the expansion device, and, optionally, an electronic motor controller in electrical communication with the motor. Refrigeration systems of the type used for air conditioning or dehumidification remove moisture from the air at the evaporator. This moisture precipitated at the evaporator is called condensate.

Precipitation of condensate at the evaporator involves removal of latent heat and is a well understood thermodynamic phenomenon. Knowing the entering and exiting temperature and relative humidity of fluid passing through an evaporator, one can calculate enthalpy and thermodynamic work. The work consists of latent heat removal and sensible heat removal. The total air flow provides the latent heat rejected and the sensible heat rejected. A psychometric chart can then be used to calculate the moisture per pound of incoming air and discharged air, the difference being the amount of moisture removed as condensate.

Normally, air conditioner system efficiency is reduced by wasted latent heat energy lost in the form of evaporator condensate. It is desirable to increase overall system efficiency by utilizing this wasted latent heat energy.

DISCLOSURE OF THE INVENTION

The present invention overcomes the above-referenced shortcomings of prior art air conditioning assemblies by providing a liquid management system for an air conditioner which includes a reservoir for accumulating condensate precipitated from the air conditioner evaporator and means for distributing the condensate for cooling selected system components. The present invention also provides a method of cooling an air conditioning system by redistributing condensate captured from the evaporator, which is typically lost as latent heat energy.

More specifically, the present invention provides an air conditioning system, as described below, which includes a liquid management system for cooling the air conditioning system. The air conditioning system provides a compressor with a motor, a condenser in fluid communication with the compressor, an expansion device in fluid communication with the condenser, an evaporator in fluid communication with the expansion device, an air moving device for the condenser and evaporator and an electronic system controller, which includes one or more motor controls as well as I/O capabilities. The evaporator precipitates a condensate due to loss of latent heat energy in operation. The liquid management system includes a reservoir for accumulating the condensate precipitated from the evaporator and means for distributing the condensate for cooling at least one selected system component.

The present invention also provides a method of cooling an air conditioning system, including a compressor with a motor, a condenser with a condenser fan, an expansion device, an evaporator precipitating a condensate, and an electronic system controller. The method comprises: (1) capturing the condensate precipitated from the evaporator; (2) distributing the condensate to the electronic system controller for cooling the electronic system controller; and (3) distributing the condensate to the condenser for cooling.

Accordingly, an object of the present invention is to increase air conditioner system efficiency by utilizing normally wasted latent heat energy.

Another object of the present invention is to provide a liquid management system using evaporator condensate to cool various system components.

Yet another object of the present invention is to provide a method of cooling an air conditioning system in which condensate precipitated from the evaporator is captured and distributed to the electronic system controller and condenser for cooling the respective system components.

The above objects and other objects, features and advantages of the present invention are readily apparent from the following detailed description of the best modes for carrying out the invention when taken in connection with the accompanying drawings.

DETAILED DESCRIPTION OF THE PREFERRED EMBODIMENT

Figure 1:
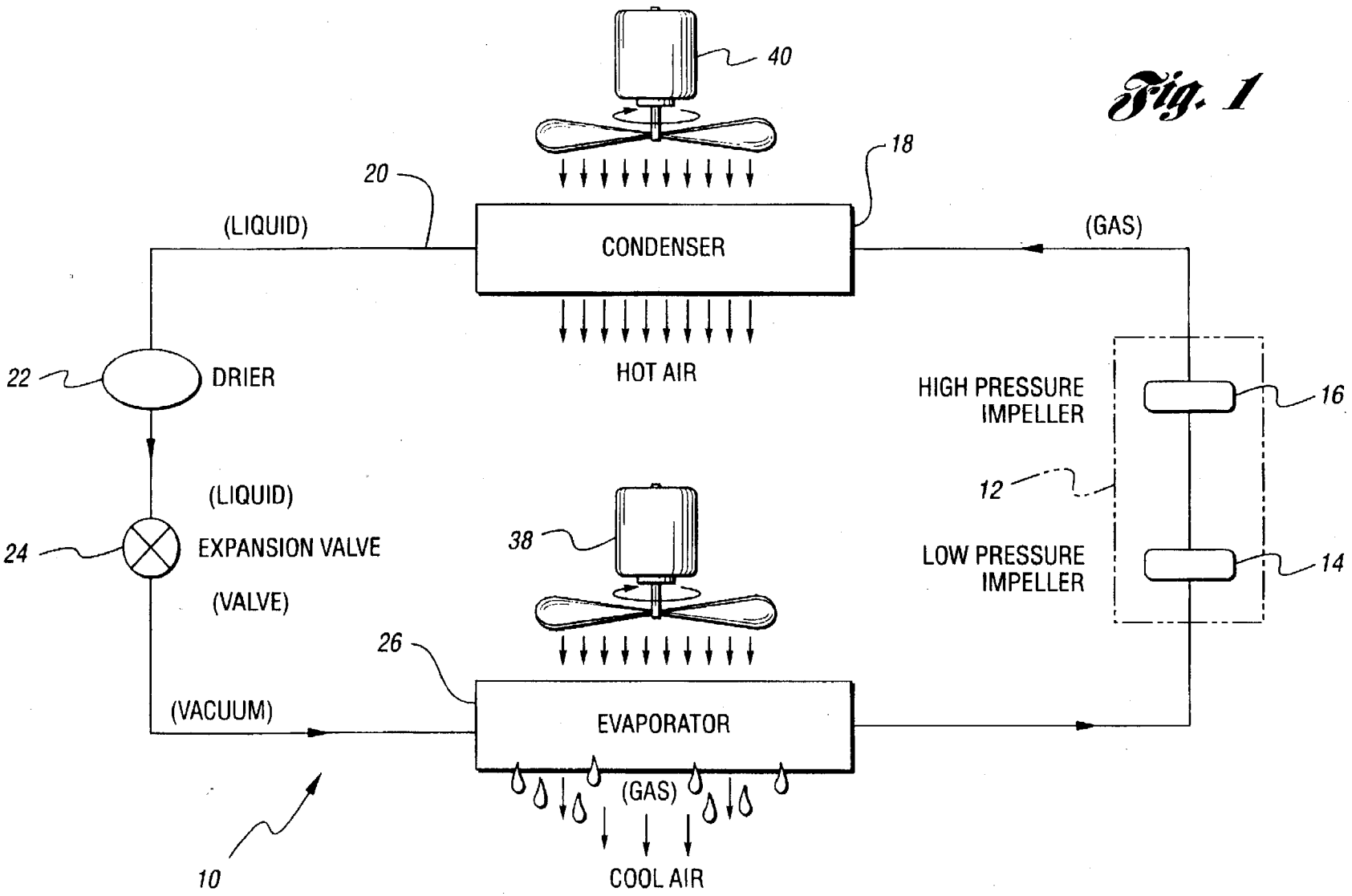
FIG. 1 shows a schematically arranged flow diagram for a vapor pressure cycle air conditioning system for use in accordance with the present invention.

A schematic depiction of a typical air conditioning system cycle is shown in FIG. 1 for use with the present invention. The air conditioning system 10 includes a compressor 12 which receives refrigerant vapor under low pressure and compresses it to a high pressure, high temperature vapor. Preferably, compressor 12 has a pair of low and high pressure impellers 14,16, however, other style compressors could be used. The high pressure, high temperature vapor then enters the condenser 18 where heat is removed and the vapor, as it cools, becomes a high pressure liquid refrigerant. The liquid line 20 then carries the compressed liquid to the dryer 22 and then to the expansion valve 24. A mechanical or electrical expansion device could be used. As the refrigerant passes through the expansion valve 24, the refrigerant's pressure is lowered. The low pressure liquid refrigerant then enters the evaporator 26 where it begins to boil and is changed into the vapor state by absorbing heat from the warm air passing over the evaporator 26. At the evaporator 26, latent heat energy is lost by precipitation of condensate which occurs as air passes over the evaporator 26.

From the evaporator 26, low pressure vapor may pass through an accumulator (not shown) en route to the compressor 12, completing the closed loop system. The accumulator may be used with a fixed or variable orifice without an expansion valve and without a receiver/dryer.

Figure 2:
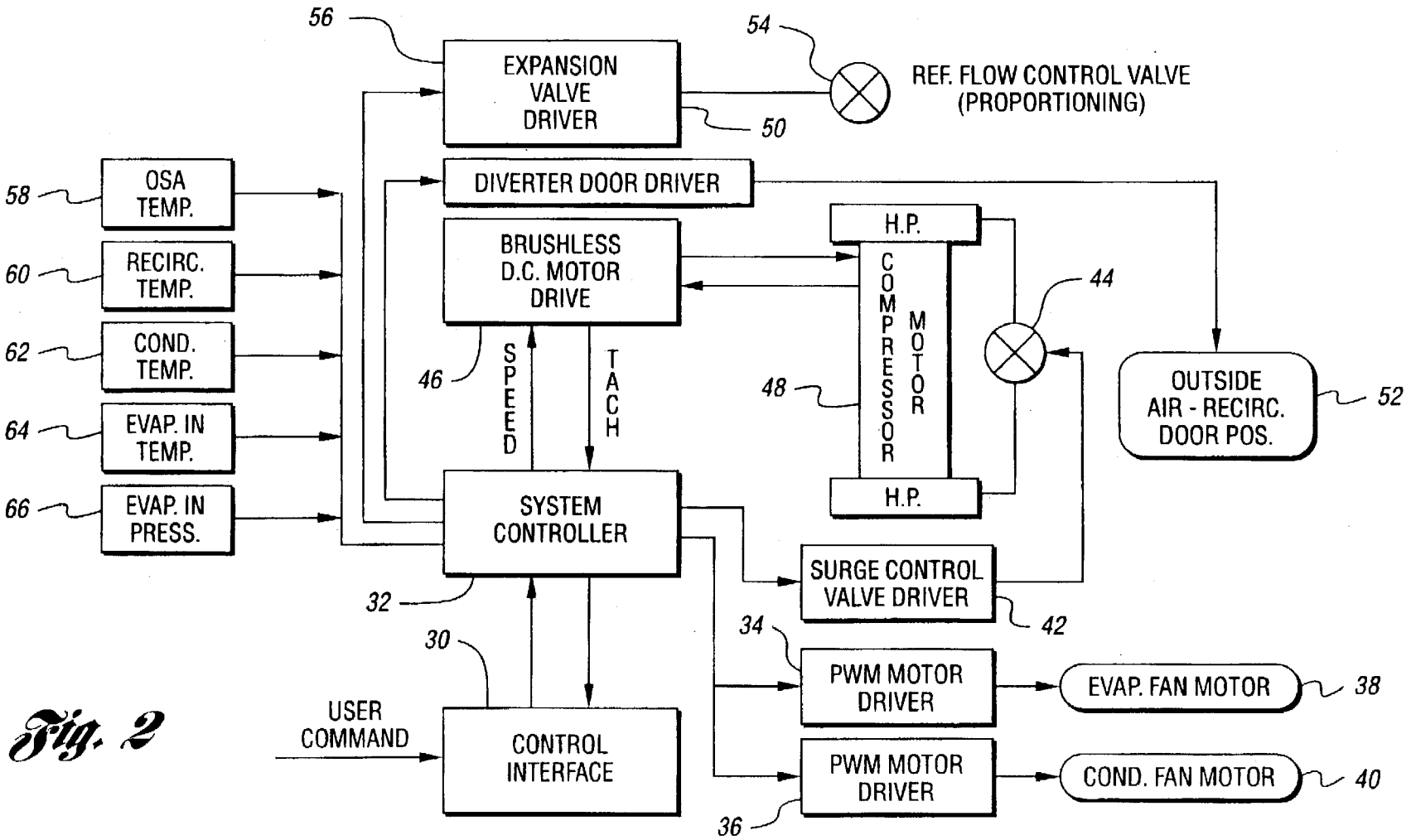
FIG. 2 shows a schematic block diagram for an air conditioning control system for use in accordance with the present invention.

Turning to FIG. 2, a typical air conditioning system control schematic for use with the present invention in an automobile air conditioning system is shown. The control system 28 includes a control interface 30 for receiving operator input. The control interface 30 communicates with the system controller 32 for controlling the air conditioning system 10 (FIG. 1). In the preferred embodiment, the controller is in electrical communication with PWM motor drives 34,36 for actuating evaporator fan motor 38 and condenser fan motor 40, respectively. The controller also communicates with the compressor motor 48 via the motor drive 46. Of course, various motor speed control devices could be used. The system controller 32 may also communicate with a surge control valve driver 42 which operates the surge control valve 44 for a centrifugal compressor. Alternatively, a positive displacement compressor could be employed which would not require the surge control valve driver 42.

A brushless dc motor drive 46 receives signals from the system controller 42 for operating the compressor motor 48. Also, a diverter door driver 50 may communicate with the system controller 32 for controlling position of the outside air recirculation door 52.

Inputs received by the system controller 32 include outside air temperature 52, recirculation temperature 60, condenser temperature 62, evaporator outlet temperature 64, and evaporator outlet pressure 66. The system controller 32 controls system flow rate by operating the expansion valve or reference flow control valve 54 through the expansion valve driver 56.

Several of the system components shown in FIGS. 1 and 2 generate unwanted heat, and therefore require cooling for improved system efficiency. The liquid management system of the present invention, as described below, captures the condensate precipitated from the evaporator 26 and distributes it to such system components as needed for cooling. The condensate may be applied directly onto the component to be cooled, or it may be passed through the component or through a heat sink device attached to the component for cooling.

Figure 3:
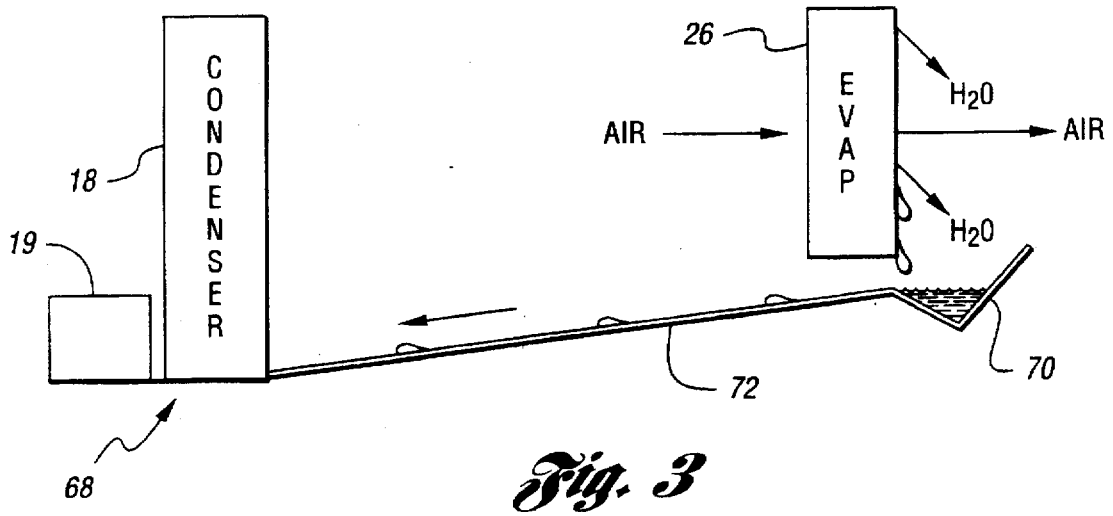
FIG. 3 shows a schematically arranged side view illustrating a liquid management system arranged in series in accordance with the present invention.
Figure 4:
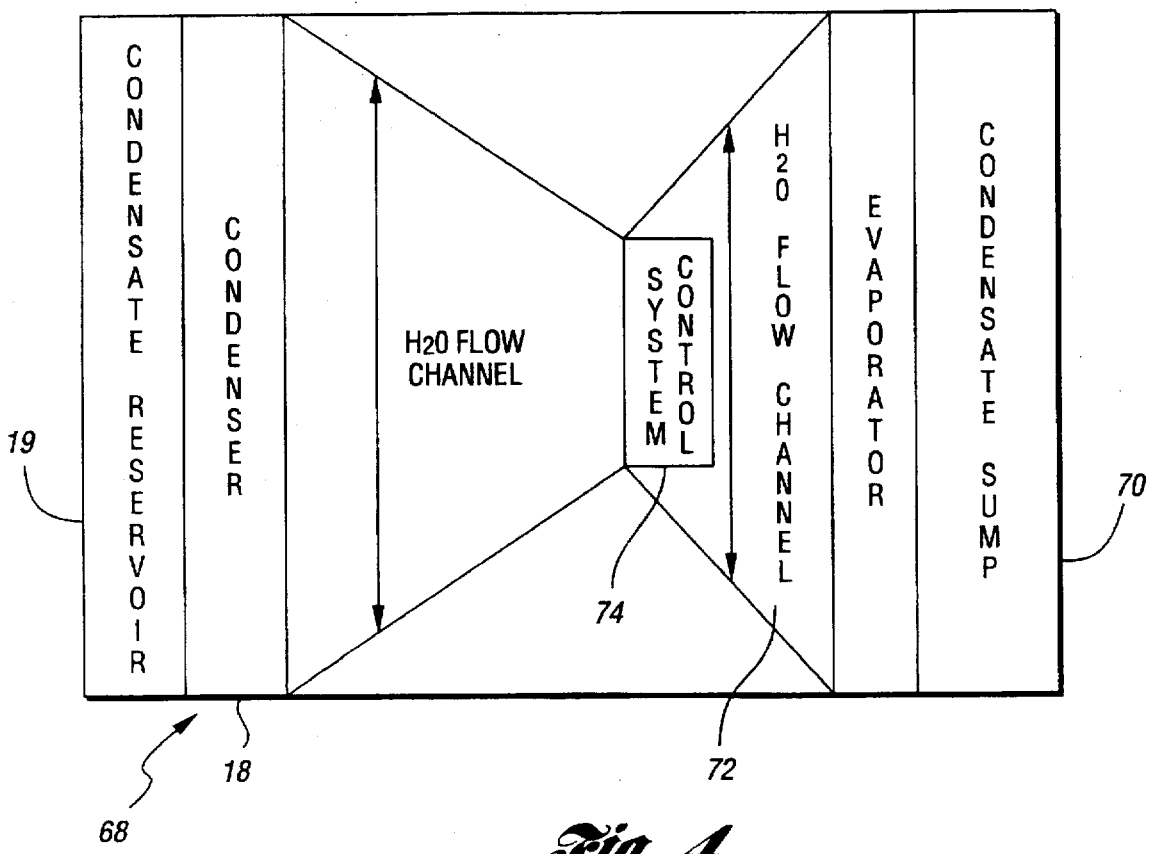
FIG. 4 shows a plan view of the schematic shown in FIG. 3.

FIGS. 3 and 4 schematically illustrate the use of evaporator condensate in cooling selected system components in series. The liquid management system 68 receives condensate ($H_2O$) precipitated from the evaporator 26 as air travels across the evaporator 26. The liquid management system 68 includes a reservoir (sump) 70 for capturing the precipitated condensate. As shown schematically in FIG. 4, the condensate travels in series from the reservoir 70 through the flow channel 72, first to the electronic motor controller 74 for cooling the controller 74, and then to the condenser 18 for cooling the condenser. This condensate may be distributed by fans blowing condensate and air out ('pusher' fans) or by fans pulling condensate, and air in through the condenser ('puller' fans). When using a puller fan, a condensate tray would be positioned adjacent the condenser inlet for vaporization across the face of the condenser. Of course, such series condensate flow could be selectively distributed to other system components for cooling. The flow distribution channels may be integrated into the base; they may also consist of plastic or metal tubes.

A reservoir 19 may be provided adjacent the condenser to collect condensate and to provide a means of distributing the condensate to the condenser via an air-side pressure differential. Also, a wick surface may be provided on the reservoir to improve liquid communication to the condenser air flow.

Figure 5:
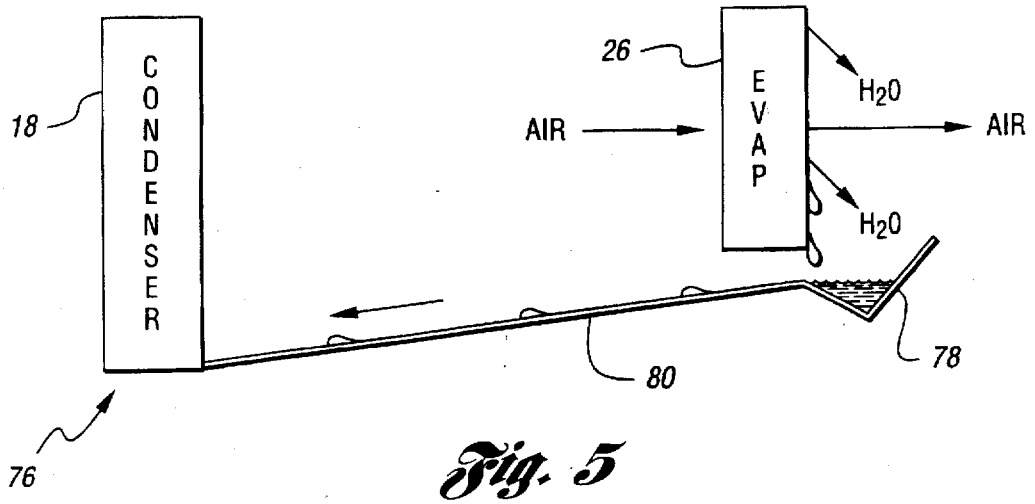
FIG. 5 shows a schematically arranged side view of a liquid management system arranged in parallel in accordance with the present invention.
Figure 6:
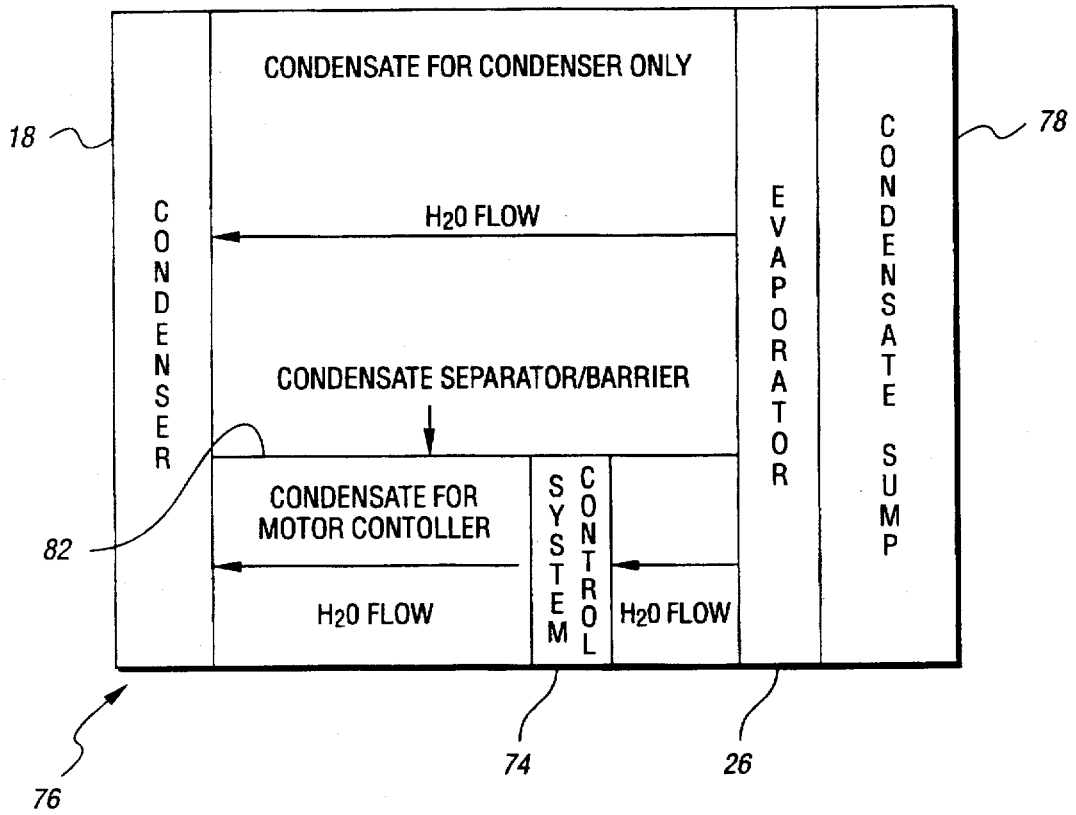
FIG. 6 shows a plan view of the schematic shown in FIG. 5.

FIGS. 5 and 6 schematically illustrate an alternative liquid management system 76 in which condensate flow is arranged in parallel for cooling the electronic system controller 74 and condenser 18 simultaneously. This system 76 includes a reservoir 78 for capturing condensate from the evaporator 26, and a flow channel 80 for distributing the condensate in parallel to the electronic system controller 74 and the condenser 18. A condensate separator 82 divides the flow channel 80 into separate paths for carrying condensate to the respective system components for cooling. The distribution channels formed by the separator 82 are sized to provide the appropriate flow rates to maximize total system heat transfer and minimize input power.

Figure 7:
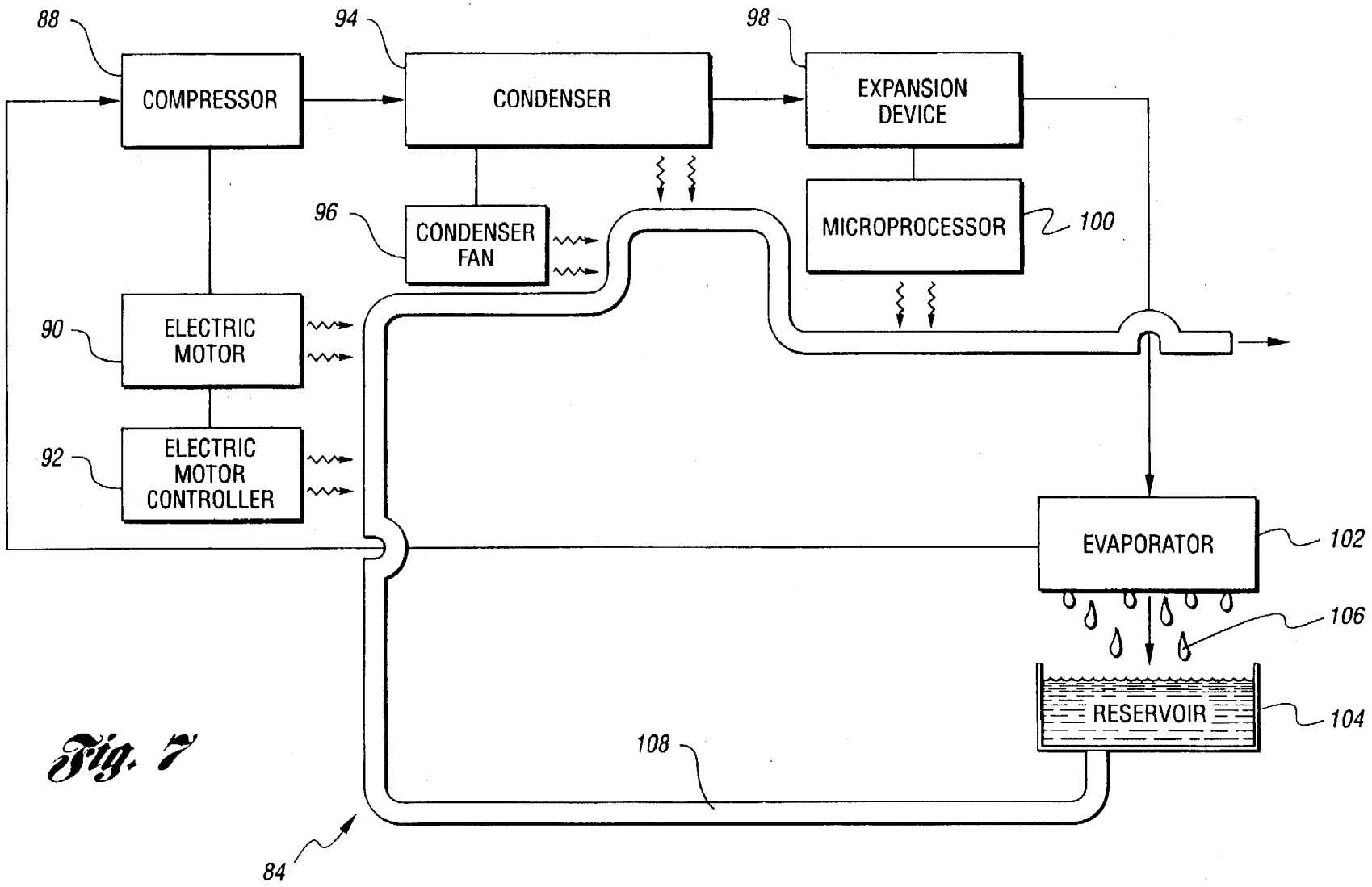
FIG. 7 shows a schematically arranged flow diagram of an alternative liquid management system in accordance with the present invention.

Another alternative liquid management system 84 is shown in FIG. 7. This liquid management system 84 is used in combination with the air conditioning system 86 shown, which includes a compressor 88 having an electric motor 90 and electronic system controller 92 connected respectively thereto, a condenser 94 including a condenser fan 96, expansion device 98 with microprocessor 100, and evaporator 102. The liquid management system 84 includes reservoir 104 which captures condensate 106 from the evaporator 102. As shown schematically, a condensate flow line 108 carries the condensate 106 to selected system components for cooling. The condensate flow line 108 may be adapted to carry condensate to one or more of the electronic system controller 92, electric motor 90, condenser fan 96, condenser 94 (which could include a subcooler), and microprocessor 100 for cooling in series or in parallel. As shown, the condensate flow line may submerge the liquid line 95 connecting the condenser 94 and the evaporator device 98 for cooling.

Of course, various configurations for the condensate liquid management system could be used for a variety of air conditioning systems. The condensate flow may be caused by gravity, evaporator fan pressurization, or condensation distribution pump. Similarly, a network of conduits and valves may be used to distribute the condensate to the needed location.

While the best modes for carrying out the invention have been described in detail, those familiar with the art to which this invention relates will recognize alternative designs and embodiments for practicing the invention. Thus, the above described preferred embodiment is intended to be illustrative of the invention which may be modified within the scope of the following appended claims.

What is claimed is:

1. An air conditioning system, comprising:

a compressor;

a motor adapted for driving the compressor;

a condenser in fluid communication with the compressor and including a condenser fan;

an expansion device in fluid communication with the condenser;

an air cooled evaporator having an inlet in fluid communication with the expansion device and an outlet coupled to the compressor to form a closed loop system which when operated precipitates a condensate from the cooling air on the evaporator, the evaporator including an evaporator fan;

an electronic system controller in electrical communication with said motor and with said condenser fan and said evaporator fan; and a liquid management system including a reservoir for accumulating said condensate precipitated on said evaporator and means for distributing the condensate for cooling said system controller.

2. An air conditioning system, comprising:

a compressor;

a motor adapted for driving the compressor;

a condenser in fluid communication with the compressor and including a condenser fan;

an expansion device in fluid communication with the condenser;

an air cooled evaporator having an inlet in fluid communication with the expansion device and an outlet coupled to the compressor to form a closed loop system which when operated precipitates a condensate from the cooling air on the evaporator, the evaporator including an evaporator fan;

an electronic system controller in electrical communication with said motor and with said condenser fan and said evaporator fan; and a liquid management system including a reservoir for accumulating said condensate precipitated on said evaporator and means for distributing the condensate for cooling at least one selected system component;

wherein said at least one system component comprises said system controller and said condenser arranged in series condensate flow relationship with respect to each other.

3. An air conditioning system, comprising:

a compressor;

a motor adapted for driving the compressor;

a condenser in fluid communication with the compressor and including a condenser fan;

an expansion device in fluid communication with the condenser;

an air cooled evaporator having an inlet in fluid communication with the expansion device and an outlet coupled to the compressor to form a closed loop system which when operated precipitates a condensate from the cooling air on the evaporator, the evaporator including an evaporator fan;

an electronic system controller in electrical communication with said motor and with said condenser fan and said evaporator fan; and a liquid management system including a reservoir for accumulating said condensate precipitated on said evaporator and means for distributing the condensate for cooling said system controller and said condenser arranged in parallel condensate flow relationship with respect to each other.

4. An air conditioning system, comprising:

a compressor;

a motor adapted for driving the compressor;

a condenser in fluid communication with the compressor and including a condenser fan;

an expansion device in fluid communication with the condenser;

an air cooled evaporator having an inlet in fluid communication with the expansion device and an outlet coupled to the compressor to form a closed loop system which when operated precipitates a condensate from the cooling air on the evaporator, the evaporator including an evaporator fan;

an electronic system controller in electrical communication with said motor and with said condenser fan and said evaporator fan;

a liquid management system including a reservoir for accumulating said condensate precipitated on said evaporator and means for distributing the condensate for cooling at least one selected system component; and a microprocessor in electrical communication with said expansion device, wherein said at least one system component comprises said microprocessor.

5. An air conditioning system, comprising:

a compressor;

a motor adapted for driving the compressor;

a condenser in fluid communication with the compressor;

an expansion device in fluid communication with the condenser;

an air cooled evaporator having an inlet in fluid communication with the expansion device and an outlet coupled to the compressor to form a closed loop system which when operated precipitates a condensate from the cooling air on the evaporator;

a liquid management system including a reservoir for accumulating said condensate precipitated on said evaporator and means for distributing said condensate for cooling said system controller.

6. An air conditioning system, comprising:

a compressor;

a motor adapted for driving the compressor;

a condenser in fluid communication with the compressor;

an expansion device in fluid communication with the condenser;

an air cooled evaporator having an inlet in fluid communication with the expansion device and an outlet coupled to the compressor to form a closed loop system which when operated precipitates a condensate from the cooling air on the evaporator;

a liquid management system including a reservoir for accumulating said condensate precipitated on said evaporator and means for distributing said condensate for cooling said system controller and said condenser arranged in series condensate flow relationship with respect to each other.

7. An air conditioning system, comprising:

a compressor;

a motor adapted for driving the compressor;

a condenser in fluid communication with the compressor;

an expansion device in fluid communication with the condenser;

an air cooled evaporator having an inlet in fluid communication with the expansion device and an outlet coupled to the compressor to form a closed loop system which when operated precipitates a condensate from the cooling air on the evaporator;

a liquid management system including a reservoir for accumulating said condensate precipitated on said evaporator and means for distributing said condensate for cooling said system controller and said condenser arranged in parallel condensate flow relationship with respect to each other.

8. An air conditioning system, comprising:

a compressor;

a motor adapted for driving the compressor;

a condenser in fluid communication with the compressor;

an expansion device in fluid communication with the condenser;

an air cooled evaporator having an inlet in fluid communication with the expansion device and an outlet coupled to the compressor to form a closed loop system which when operated precipitates a condensate from the cooling air on the evaporator;

a liquid management system including a reservoir for accumulating said condensate precipitated on said evaporator and means for distributing said condensate for cooling at least one selected system component; and a microprocessor in electrical communication with said expansion device, wherein said at least one system component comprises said microprocessor.

9. A method of cooling an air conditioning system, including a compressor; a motor adapted for driving the compressor; a condenser in fluid communication with the compressor, said condenser having a condenser fan; an expansion device in fluid communication with the condenser; an evaporator in fluid communication with the expansion device, said evaporator precipitating a condensate; and an electronic motor controller in electrical communication with said motor; the method comprising:

capturing said condensate precipitated from said evaporator;

distributing said condensate to said electronic motor controller for cooling said electronic motor controller; and distributing said condensate to said condenser for cooling said condenser.

* * * * *